US008360594B2

(12) United States Patent
Sant et al.

(10) Patent No.: US 8,360,594 B2
(45) Date of Patent: Jan. 29, 2013

(54) ATTACHABLE PORTABLE LIGHTING DEVICE AND METHODS OF OPERATION

(75) Inventors: Earl K Sant, Avon Lake, OH (US); Lai King Ma, Fanling (HK); Frank F Huang, Lakewood, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 13/042,862

(22) Filed: Mar. 8, 2011

(65) Prior Publication Data

US 2011/0157874 A1 Jun. 30, 2011

Related U.S. Application Data

(63) Continuation of application No. PCT/US2009/005079, filed on Sep. 10, 2009.

(60) Provisional application No. 61/095,794, filed on Sep. 10, 2008.

(51) Int. Cl.
*F21V 21/08* (2006.01)

(52) U.S. Cl. ..... 362/106; 362/103; 362/39; 362/346; 362/235

(58) Field of Classification Search ..... 362/105, 362/106, 396, 190, 191, 473, 476, 474
See application file for complete search history.

(56) References Cited

U.S. PATENT DOCUMENTS

| | | | | |
|---|---|---|---|---|
| 5,448,459 | A * | 9/1995 | Rogers | 362/191 |
| 6,619,813 | B1 * | 9/2003 | Schnell | 362/116 |
| 6,719,437 | B2 | 4/2004 | Lary et al. | |
| 6,834,986 | B2 * | 12/2004 | Tsukamoto | 362/475 |
| 7,172,309 | B2 | 2/2007 | Parsons | |
| 7,461,944 | B2 * | 12/2008 | Alessio | 362/184 |
| 7,918,578 | B2 * | 4/2011 | Spartano et al. | 362/105 |
| 2003/0179570 | A1 | 9/2003 | Schnell | |

FOREIGN PATENT DOCUMENTS

| | | | |
|---|---|---|---|
| JP | 2006-185755 | A | 7/2006 |
| JP | 3961808 | B2 | 8/2007 |
| JP | 2007/230374 | * | 9/2007 |
| JP | 2007230374 | A | 9/2007 |
| KR | 20-0412315 | Y1 | 3/2006 |

OTHER PUBLICATIONS

Patent Cooperation Treaty (PCT), International Search Report and Written Opinion for Application No. PCT/US2009/005079, filed Sep. 10, 2009, mailed Apr. 23, 2010, Korean Intellectual Property Office, Republic of Korea.

* cited by examiner

*Primary Examiner* — Ali Alavi
(74) *Attorney, Agent, or Firm* — Michael C. Pophal

(57) ABSTRACT

A lighting device includes a housing, one or more light sources, one or more lenses and an attachment mechanism or clip. The housing includes a front end, a lower surface, and an upper surface. The one or more light sources are positioned at a front end of the housing. The one or more lenses are positioned proximate to the light sources. The clip or the attachment mechanism is coupled to the lower surface of the housing.

20 Claims, 12 Drawing Sheets

ATTACHABLE PORTABLE LIGHTING DEVICE AND METHODS OF OPERATION

RELATED APPLICATIONS

This application is a continuation of International Application PCT No. US2009/005079, filed Sep. 10, 2009, which claimed the benefit of U.S. Provisional Application No. 61/095,794, filed Sep. 10, 2008, the contents of which are hereby incorporated by reference.

FIELD OF THE INVENTION

The present invention generally relates to portable lighting devices, and more particularly, to portable lighting devices attachable to apparel and/or surfaces.

BACKGROUND OF THE INVENTION

Portable lighting devices are prevalent and provide users with the ability and convenience of portable lighting. One type of portable lighting device includes handheld flashlights which require a user to hold and direct an emitted light beam as desired. Another type of portable lighting device is hands free and includes, head lights or head lamps, and clip lights or cap lights. The head lamps typically attach to a person's head via a strap and permit hands free direction of light there from. Clip lights or cap lights attach to a garment, cap, hat, or other apparel and also permit hands free operation. Clip lights or cap lights can additionally be attached to other surfaces or structures, such as a table or wall.

SUMMARY OF THE INVENTION

The invention includes systems and methods related to portable lighting devices, including attachable lighting devices. The devices include lenses that facilitate shaping the light emitted by light sources of the device.

In accordance with an aspect of the invention, a clip on lighting device is disclosed. The lighting device includes a housing, one or more light sources, one or more lenses and an attachment mechanism or clip. The housing includes a front end, a lower surface, and an upper surface. The one or more light sources are positioned at a front end of the housing. The one or more lenses are positioned proximate to the light sources 110. The clip or the attachment mechanism is coupled to the lower surface of the housing.

In accordance with another aspect of the invention, a lighting device is disclosed that includes magnifier lenses and light sources. There are less lenses than light sources. Each lens is arranged with a corresponding light source and light emitted by the corresponding light source travels through the lens. At least one light source emits light that does not traverse a lens.

In accordance with yet another aspect of the invention, a lighting device is disclosed that includes magnifier lens(es), light sourc(es), and an attachment mechanism. The attachment mechanism, for example a clip, can be removably attached to an apparel item. In one example, the apparel item is a baseball cap with a brim:

BRIEF DESCRIPTION OF THE DRAWINGS

These and other features of the portable lighting devices with adjustable brightness will be more readily understood from the following detailed description of the various aspects of the embodiments taken in conjunction with the accompanying drawings in which:

FIG. 7 is a view of a lighting device attached to a cap with light sources on.

Figure 1A:
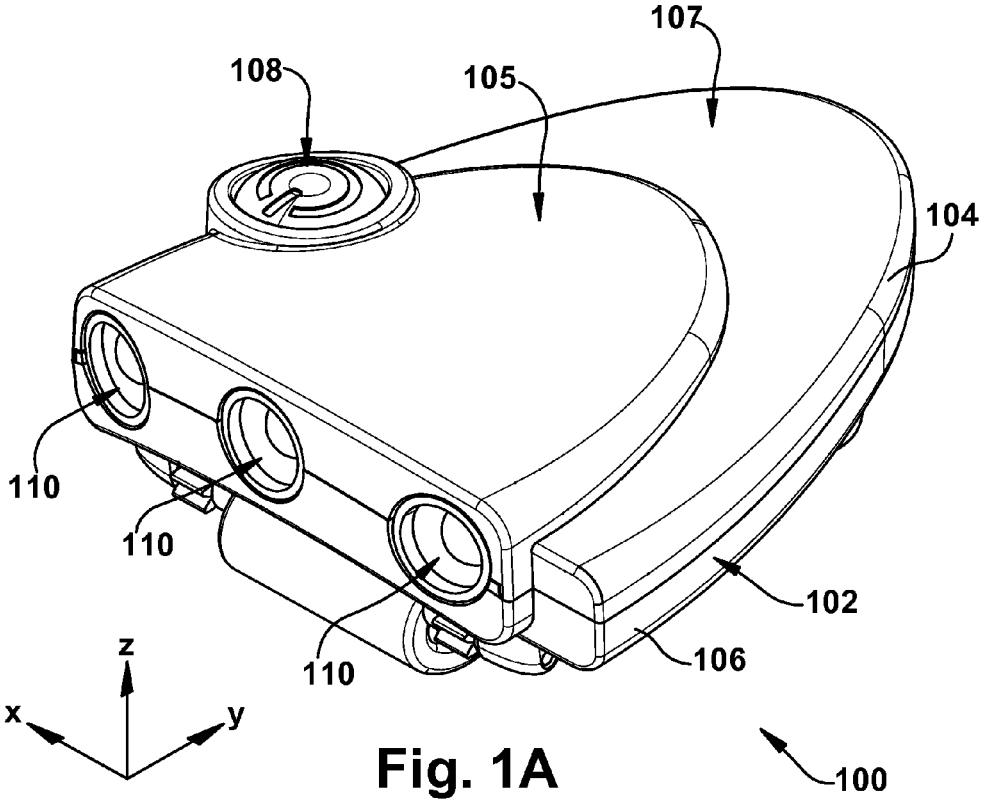
FIG. 1A is a diagram of a lighting device according to an embodiment of the invention.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1A is a diagram of a lighting device 100. The lighting device 100 can be attached to a cap (not shown), hats, other apparel, and/or other devices or structures and can provide hands free operation. In one example, the lighting device 100 is a clip on lighting device. The cap can be used for various purposes such as fashion, safety, sporting events, and the like. Other suitable apparel items include helmets, winter hats, headbands, and the like.

The lighting device 100 includes a housing 102 that comprises an upper portion 104 and a lower portion 106. The housing 102 has an upper surface proximate the upper portion 104 and a lower surface proximate the lower portion 106. The housing 102 encases various components of the device 100 and can mitigate damage to the encased components. In one example, the housing 102 provides a weather proof standard of protection. In another example, the housing 102 provides a water proof standard of protection. The housing 102 is comprised of a suitable material, for example, ABS (Acrylonitrile Butadiene Styrene) or plastic. Some examples of other material that can be employed include Metals, Rubber, Poly Carbonates, Polypropylene, Polyethylene or ABS Blends, aluminum, aluminum alloys, and the like. The upper portion 104 and the lower portion 106 are attached or fastened together to form the housing 102. In one example, threaded screws are employed to attach the lower portion 106 and the upper portion 104. In another example, an adhesive material or glue is employed to attach the portions 104 and 106. Further, methods such as ultrasonic welding can be employed to attach the portions 106 104. Additionally, a rubber like ring of material can be employed to facilitate sealing air/water at attachment locations of the portions 104 and 106.

In an alternate embodiment, the housing 102 is not relied upon as a barrier for water proof and/or weather proof types of protection. Instead, internal components, such as circuit boards, contacts, and the like are protected by a layer or coating. For example, a conformal coating can be applied to the internal components to provide a water proof type of protection and thus, permit device operation underwater. Some examples of suitable conformal coatings include gel KE-3421 from ShinEtsu or 3-4222 dielectric gel from Dow Corning, and the like.

The upper portion 104 includes a first portion 105 that provides a larger interior thickness in the z direction, which provides interior volume for components than a second portion 107, which permits a smaller thickness in the z direction. A label and/or other indicia is shown on the first portion 105.

The lighting device 100 additionally includes a switch mechanism 108. In FIG. 1, the switch mechanism 108 is depicted as a push button switch, however it is appreciated that other types of mechanisms, such as sliding switches, knobs, and the like can be employed instead.

The lighting device 100 includes one or more light sources 110. The light sources 110 can comprise suitable light sources, such as LEDs, incandescent lamps, and the like. The light sources 110 have a color/wavelength or type of light emitted there from. Some examples of suitable colors or types include white, blue, ultraviolet, infra red, red, green, and the like. Furthermore, individual lights of the light sources 110 can vary in color and intensity of the emitted light.

In operation, the switch mechanism 108 turns on and off the lighting device 100 and the light emitted. Additionally, the switch mechanism 108 can control operation of the light sources 110 as a group and individually. For example, the switch mechanism 108 can be employed to select individual light sources to turn on and off, for example, to select a source with a particular color of light.

Additionally, the switch mechanism 108 can alter the intensity of the light emitted by the light sources 110. For example, repeated pressing of the mechanism 108 can be employed to select varied levels of intensity. Alternately, a second mechanism (not shown) can be employed to adjust intensity of the light sources, individually and/or collectively.

Figure 1B:
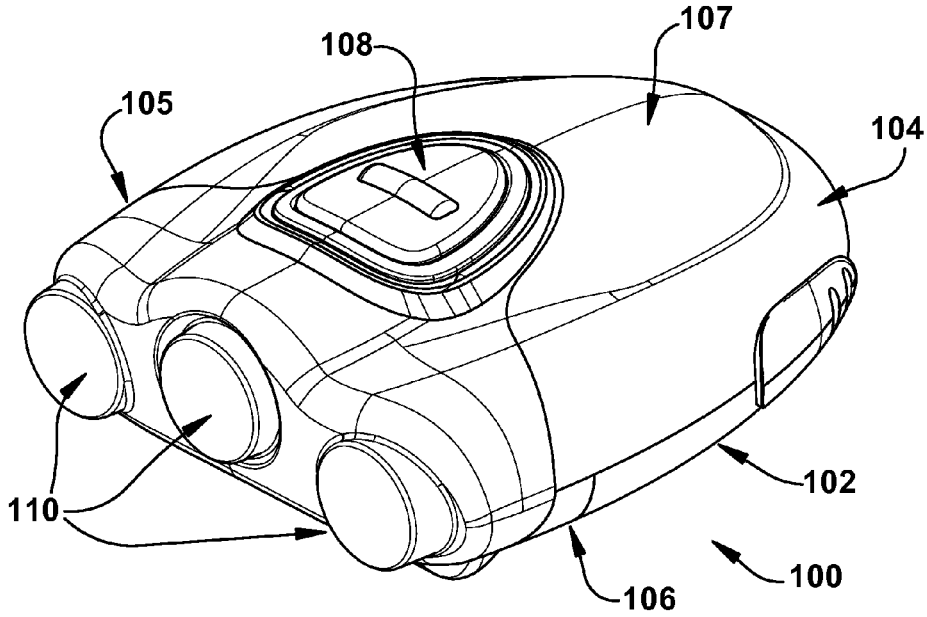
FIG. 1B is a diagram of a lighting device according to an embodiment of the invention.

FIG. 1B is a diagram of a lighting device 150 similar to that shown in FIG. 1A. The device of FIG. 1B utilizes the lower portion 106 as a battery door.

Figure 2A:
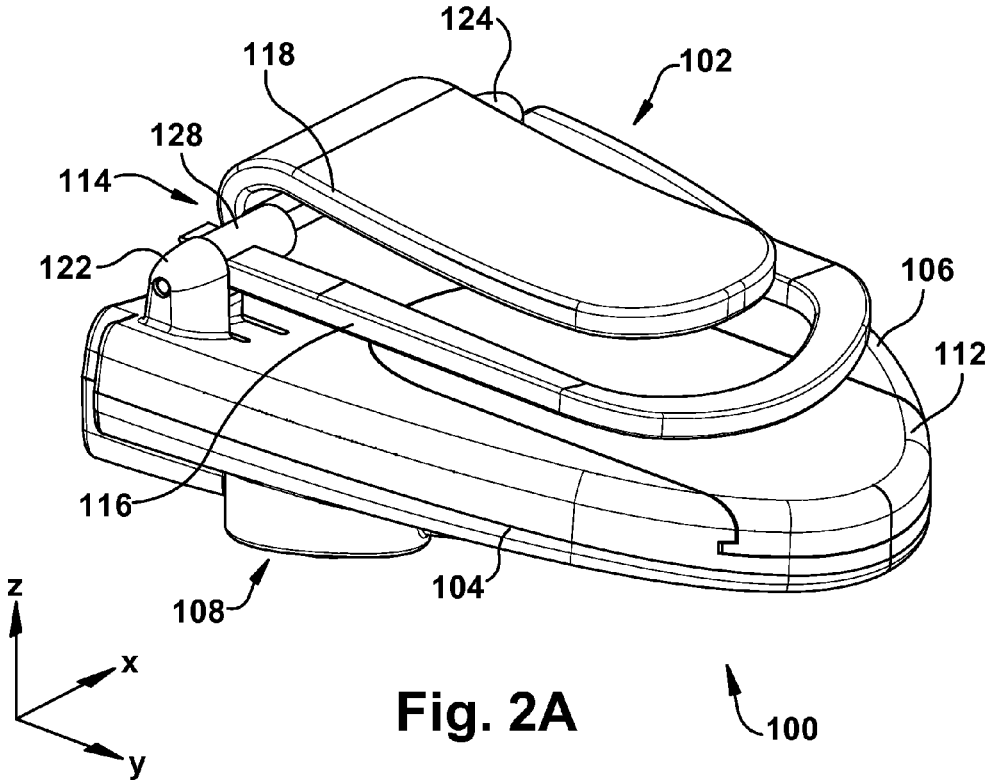
FIG. 2A is another diagram of a lighting device according to an embodiment of the invention.

FIG. 2A is another diagram of the lighting device 100 as a bottom perspective view. A lower portion 106 of the housing 102 includes a battery door 112 that can open to permit insertion or removal of batteries from the housing 102.

A clip 114 is attached to the lower portion 106 by an attachment mechanism 122. It is appreciated that alternate embodiments include, for example, attaching the clip 114 to the upper portion 104.

The clip 114 permits attachment of the device 100 to an item such as apparel, hats, caps, devices, structures, and the like. The clip 114, in this embodiment, is shown with a clip top portion 116 and a clip bottom portion 118, wherein the clip top portion 116 is generally nearer the lower portion 106 of the housing 102. The clip top portion 116 can serve to stabilize attachment to the item by mitigating gaps between the clip top portion 116 and the item. The clip bottom portion 118 flexes and exerts a clamping pressure toward and through the top portion 116 to attach the device 100 to the item and permit removal of the device 100 from the item. The clip 114 is comprised of a suitable material, for example Metals, Polyethylene, Polypropylene, Poly Carbonates or ABS and ABS Blends, and the like.

The attachment mechanism 122, as stated above, attaches the clip 114 to the lower portion 106. FIG. 2 depicts the attachment mechanism 122 as a hinged mechanism, however other types of mechanisms can be employed. For examples, a suitable attachment mechanism 122 includes a rotatable and/or pivoting mechanism that rotates and/or pivots about all directions.

Figure 2B:
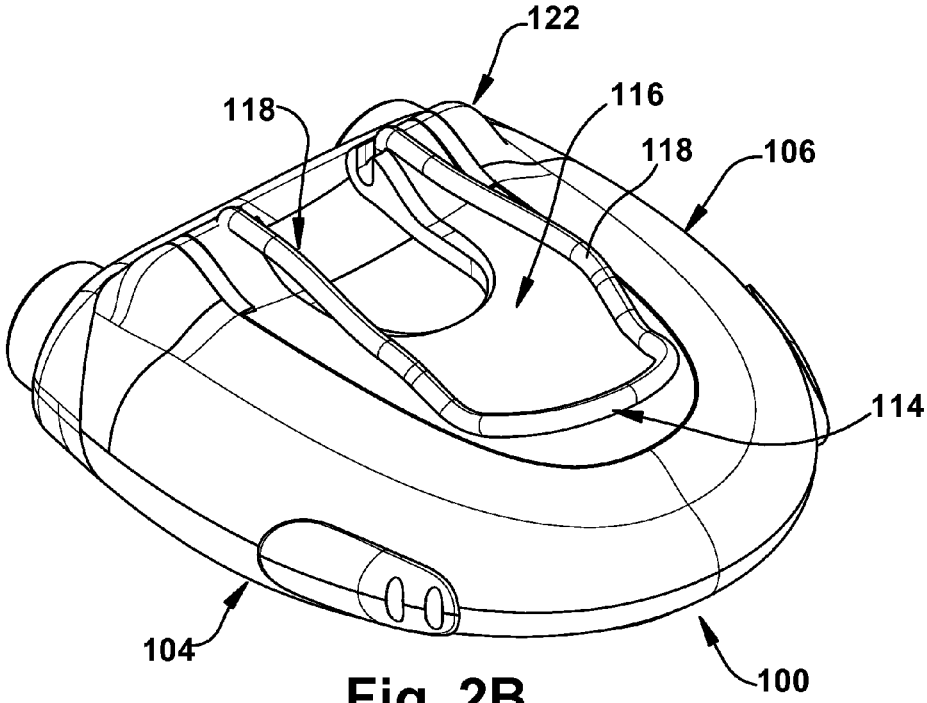
FIG. 2B is another diagram of a lighting device according to an embodiment of the invention.

FIG. 2B is a diagram of the lighting device 150 shown in a bottom perspective view.

Figure 3A:
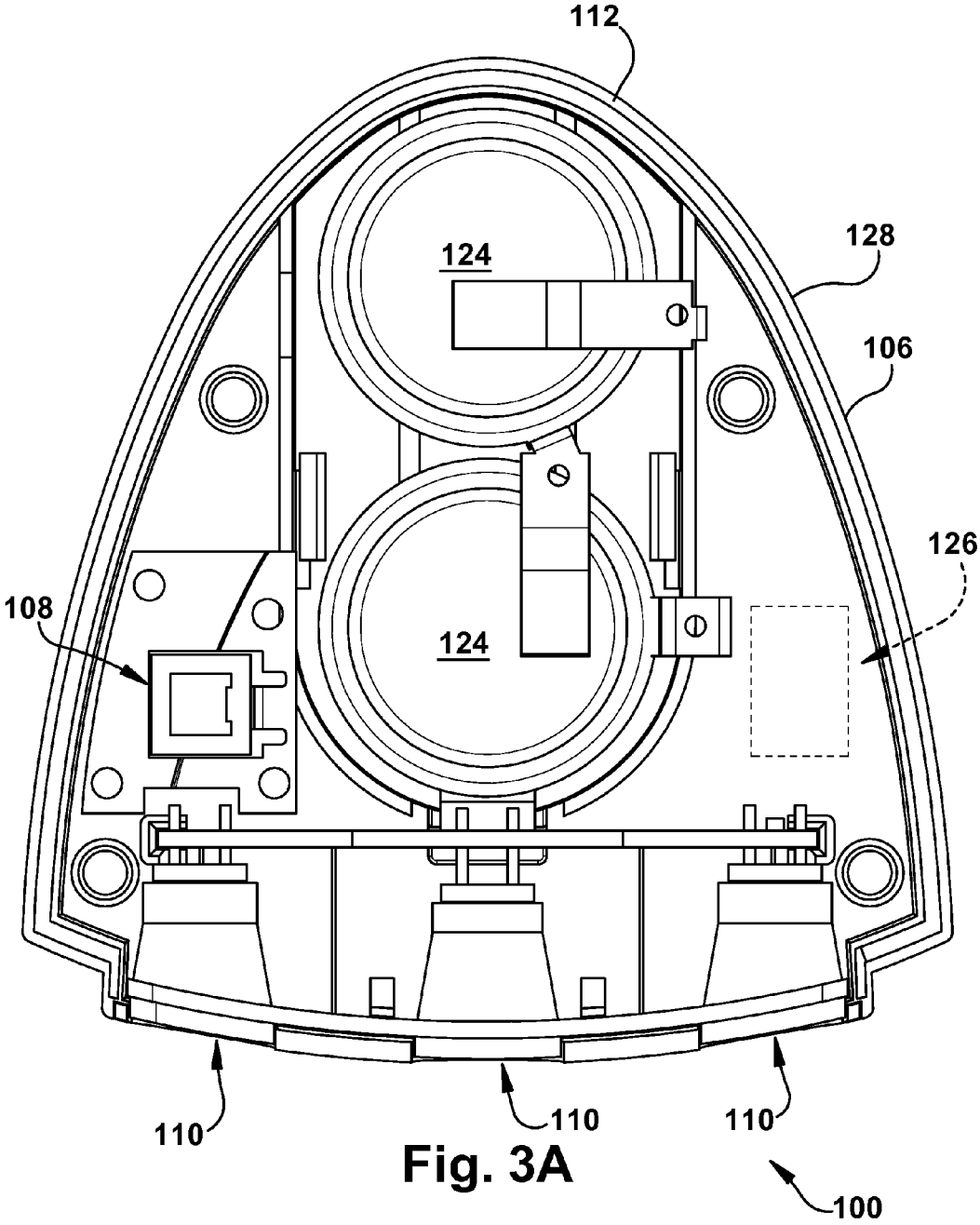
FIG. 3A is a cross sectional diagram of a lighting device according to an embodiment of the invention.

FIG. 3A is a cross sectional view of the lighting device 100. One or more batteries 124 are present within a battery cavity of the housing 102. In one example, the batteries 124 are lithium 2032 batteries connected in series. Other examples of suitable batteries 124 include lithium ion, alkaline, nickel metal hydride, carbon zinc, zinc air prismatic, and the like. A portion of the switch mechanism 108 is shown.

A region 126 is shown wherein circuitry and components can be located. The region 126 can include a controller, charging circuitry, and the like. Additionally, the device 100 can include a charging port 128 to receive external power for device operation and/or charging of the batteries 124.

Figure 3B:
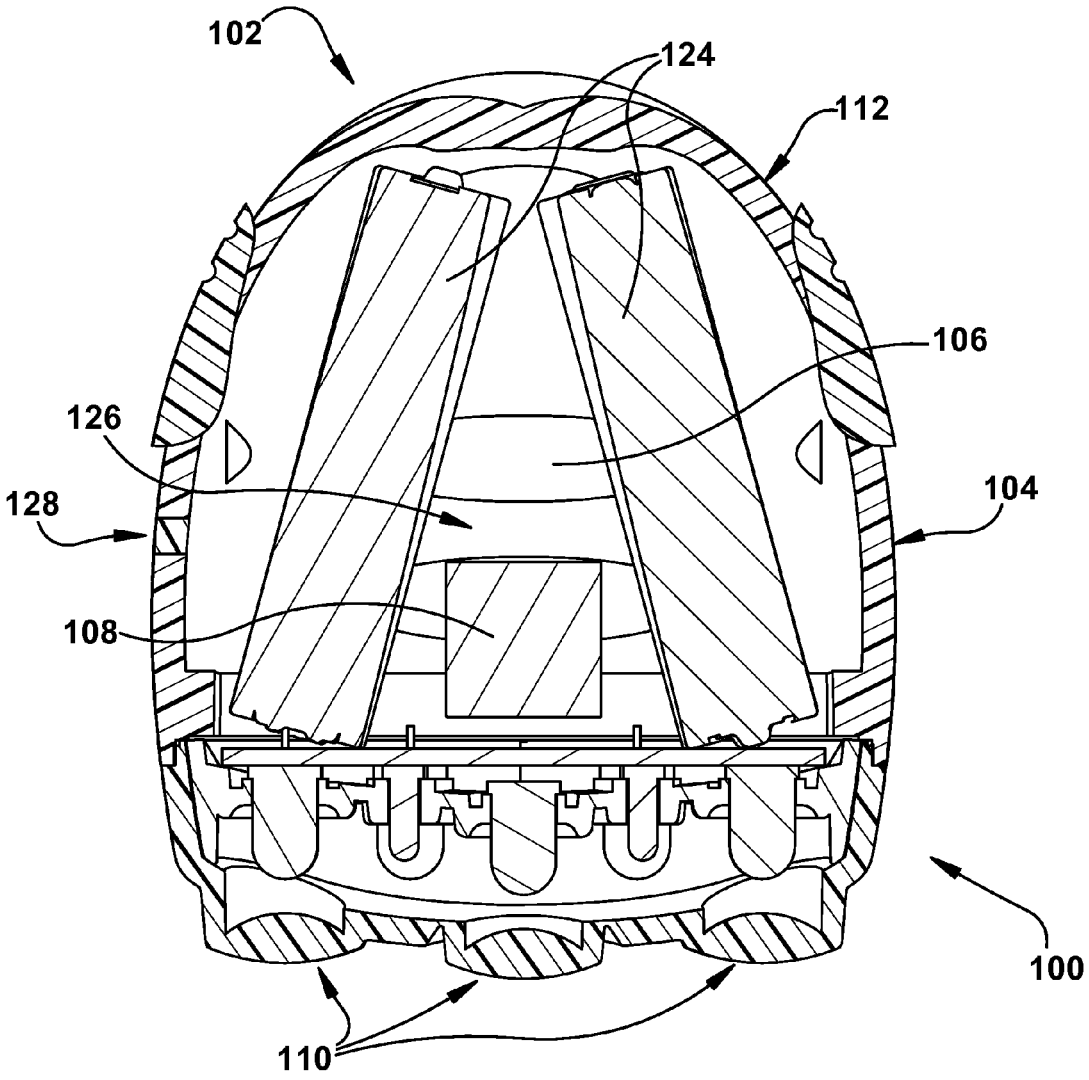
FIG. 3B is a cross sectional diagram of a lighting device according to an embodiment of the invention.

FIG. 3B is a cross sectional view of the lighting device 150. The one or more batteries 124 are shown as round cell batteries. In one example, the batteries 124 are AAA sized.

Figure 4A:
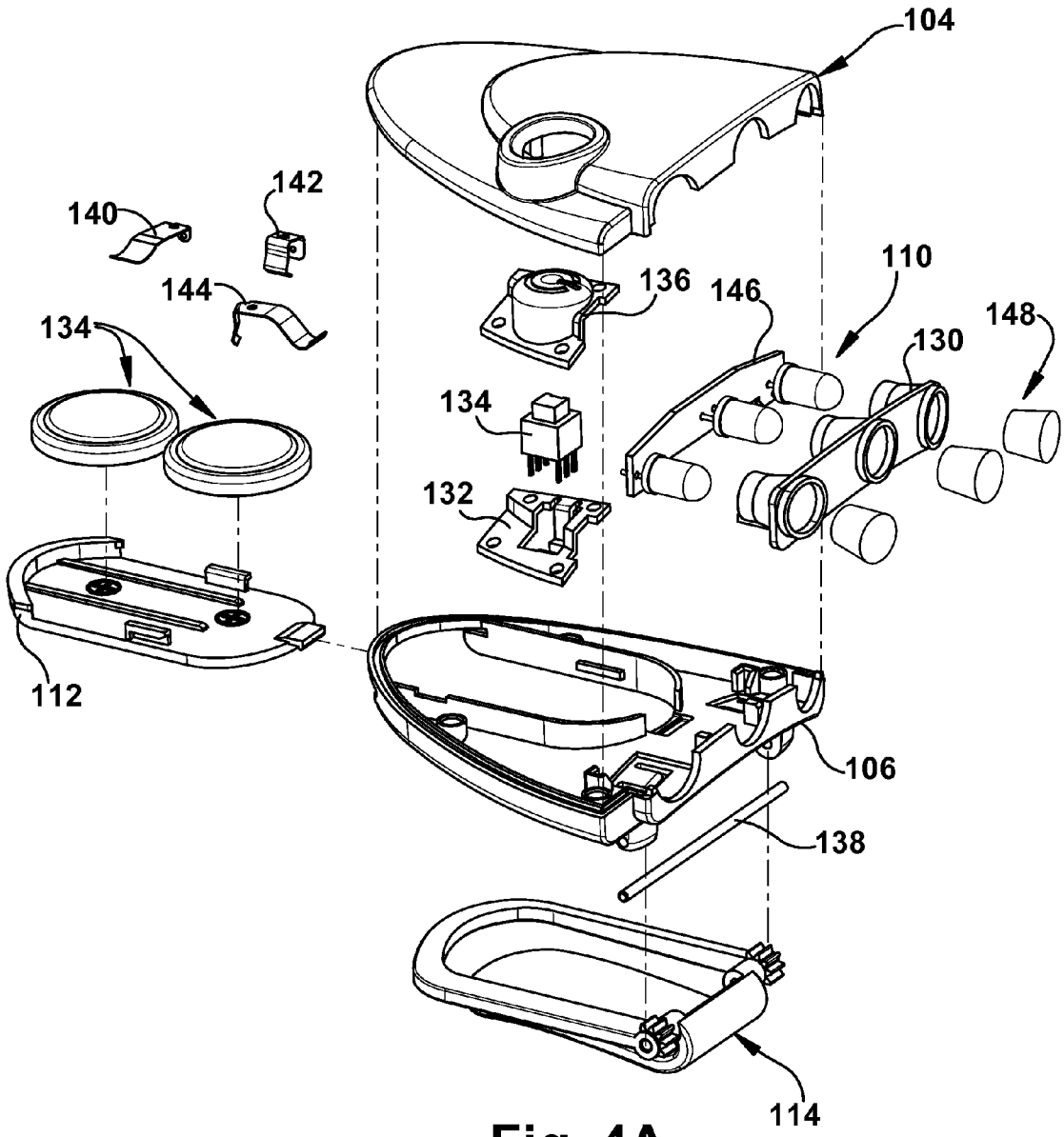
FIG. 4A is an assembly diagram of a lighting device according to an embodiment of the invention.

FIG. 4A is an assembly view of the device 100. The switch mechanism 108 is shown comprising a button frame 132, a switch boot 136, and a push switch 134, in this example. The device 100 includes a reflector 130 to reflection emitted light in a suitable direction. It is appreciated that the reflector 130 can be omitted in alternate embodiments of the invention, for example, some spot type LEDs have a reduced benefit from utilizing a reflector. However, the reflector 130 may be omitted. In another example, the reflector 130 facilitates operation for light sources 110 that include relatively wide light beams or flood beams.

Figure 3C:
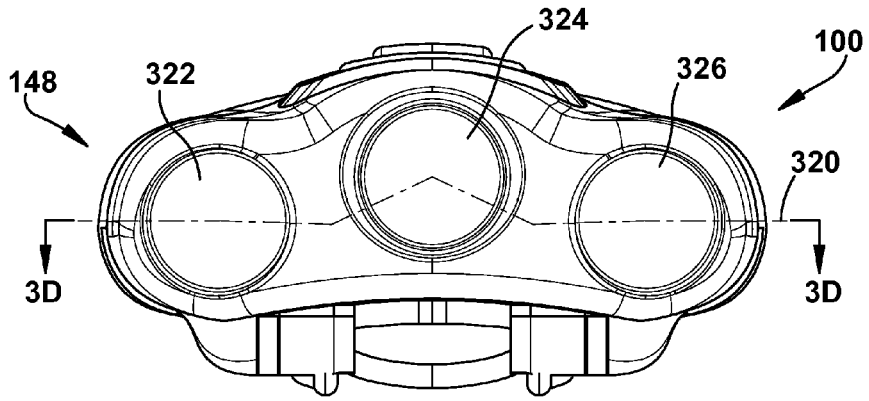
FIG. 3C is a front view of a lighting device according to an embodiment of the invention.
Figure 3D:
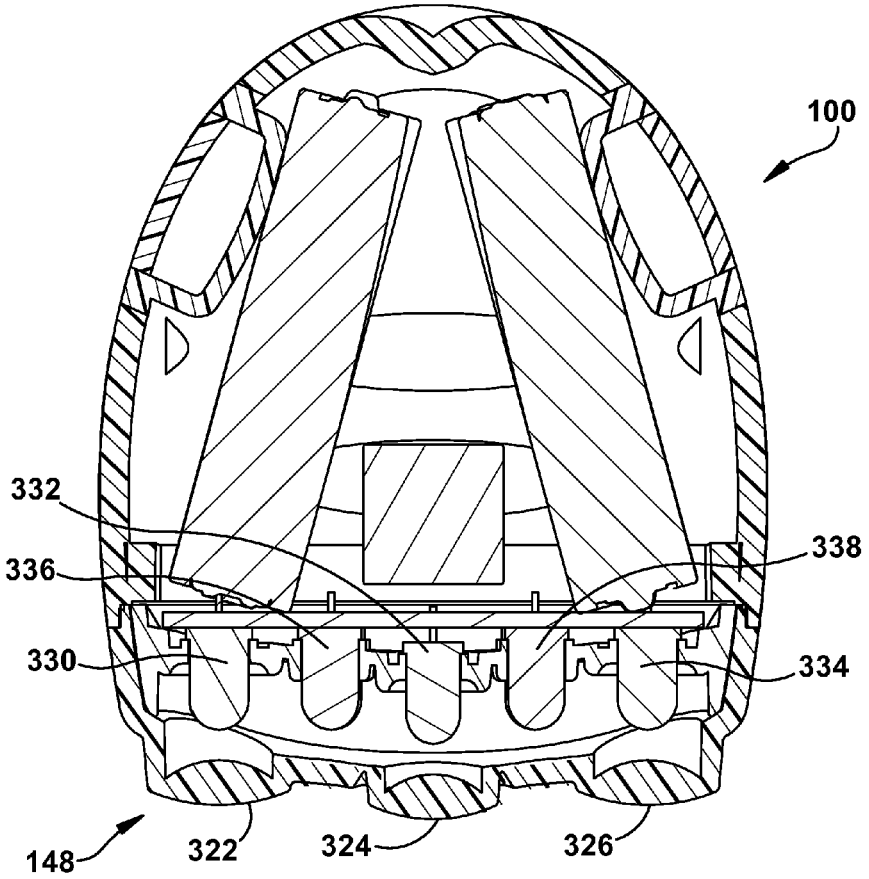
FIG. 3D is a cross sectional diagram of a lighting device according to an embodiment of the invention.

The attachment mechanism or clip 122 is shown comprising a pin 138 to provide pivoting capabilities. The battery door 112 and/or the battery cavity is shown comprising a negative contact strip 140, a positive contact strip 142, and a common contact strip 144. The device 100 includes a PCBA board for mounting the light sources 110 there to. The light sources 110 can include a variety of beam shapes including spot patterns (e.g., about 12 degrees from a central axis of travel in one example) and flood patterns (e.g., about 60 degrees from a central axis of travel in one example). Other beam shapes and variations thereof are contemplated for the light sources 110. As illustrated in FIGS. 3C and 3D, the device 100 also includes one or more lenses 148 that interact with light emitted from the light sources 110. The lenses 148 can selectively alter the light emitted to form spot and/or flood patterns. For example, the lenses 148 can comprise total internal reflectance lenses (TIR) that alter the path of the emitted light. As another example, the lenses 148 can include convex lenses that converge or focus the beam of the emitted light or concave lenses that diffuse or diverge the beam. As yet another example, the lenses 148 can include Fresnel lens and holographic type lenses, which can facilitate flood light is preferred since more light is coupled out. Some examples of suitable lenses and/or materials include polycarbonate (PC), or Poly(methyl methacrylate) (PMMA), glass, acrylic, and the like.

Figure 4B:
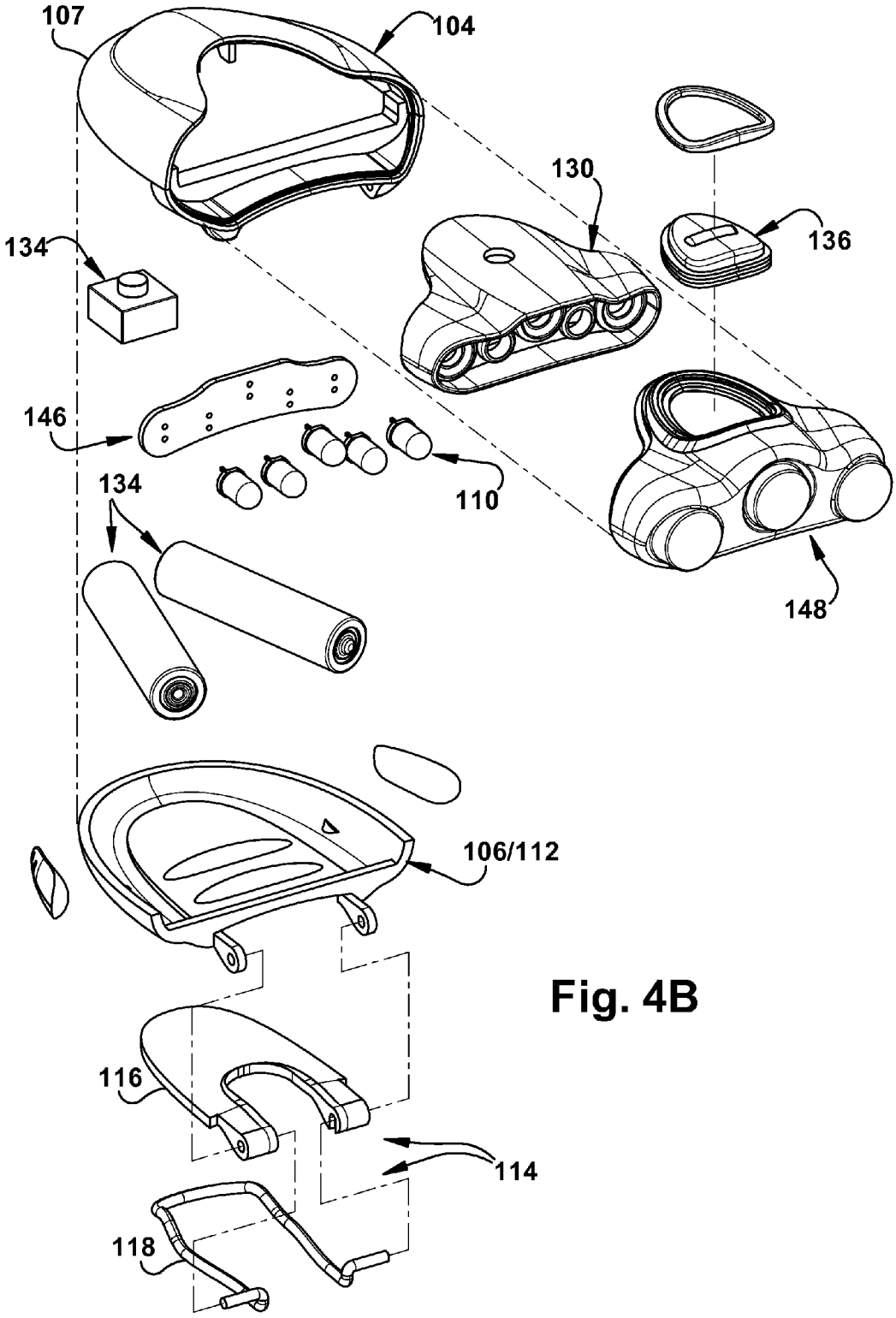
FIG. 4B is an assembly diagram of a lighting device according to an embodiment of the invention.

FIG. 4B is an assembly view of the device 150. In this view, the lenses 148 are integrated into a translucent cover.

It is further appreciated that the devices 100 and 150 described above are provided with details for illustrative purposes only. It is appreciated that alterations and modifications are contemplated in accordance with the invention.

Figure 5:
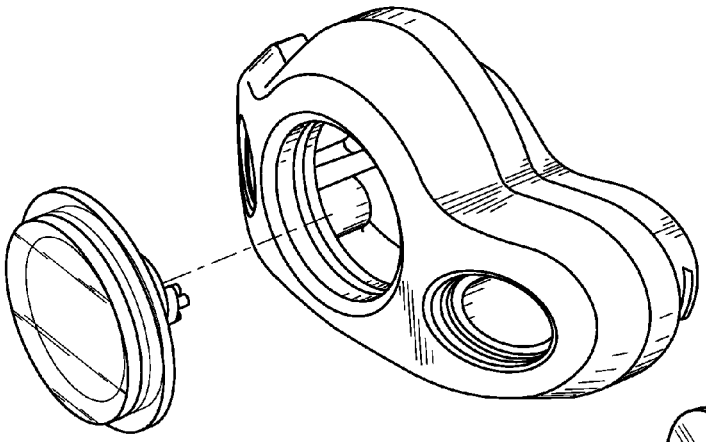
FIG. 5 is a diagram of a lens and lens assembly

FIG. 5 is a diagram of a lens and lens assembly. The lens shown could be attached, for example, as the lens 148 to the device 100. The lens and lens assembly are shown for illustrative purposes and it is appreciated that the invention contemplates other lenses and configurations.

Figure 6:
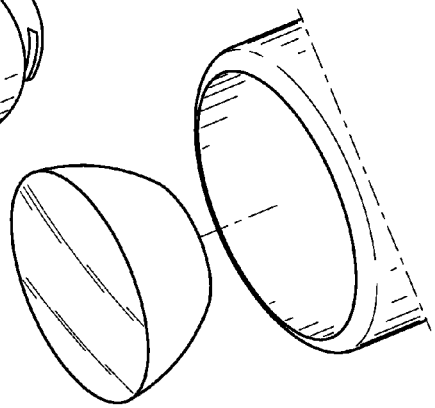
FIG. 6 is a diagram of a TIR lens

FIG. 6 is a diagram of a total internal reflectance (TIR) lens. This lens can be aligned with a light source to alter the size and shape of the beam produced.

Figure 7:
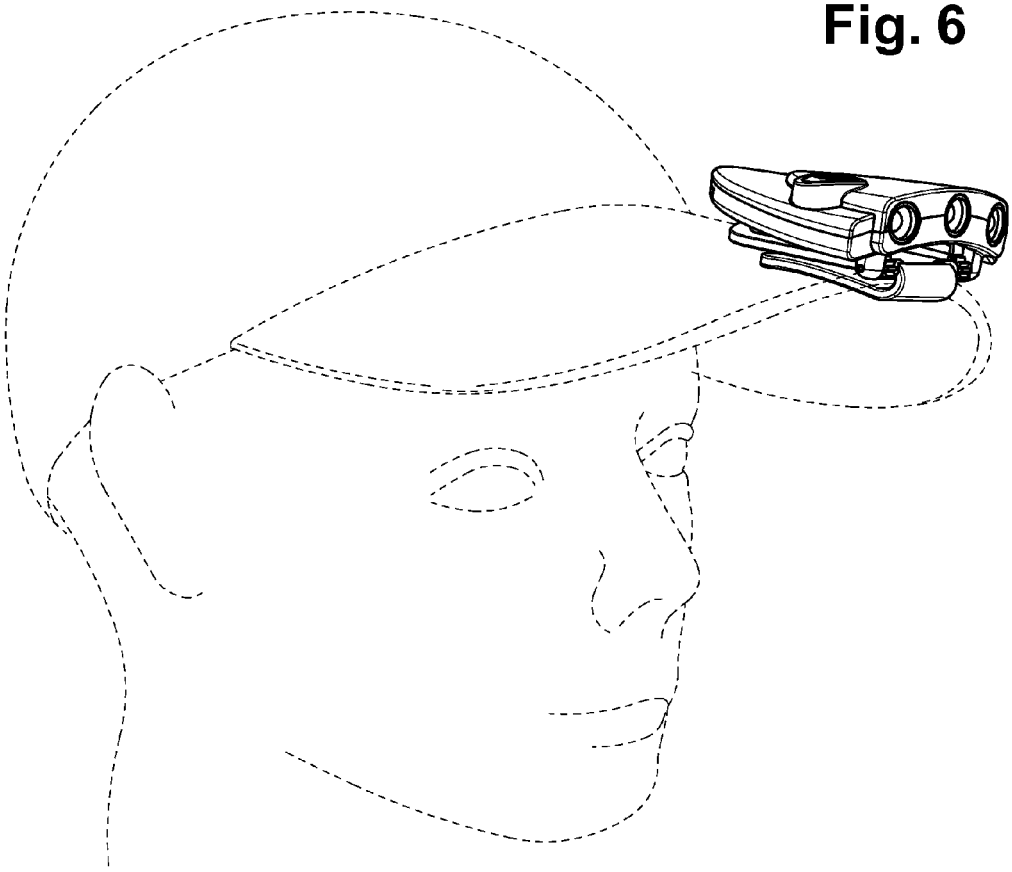

FIG. 7 is a view of a lighting device attached to a cap with light sources on. A clip removably attaches the lighting device to a brim of a cap. The lighting device in this example is shown attached to a top of the brim, however it is appreciated that embodiments of the invention contemplate attachment to a bottom of the brim.

Figure 8:
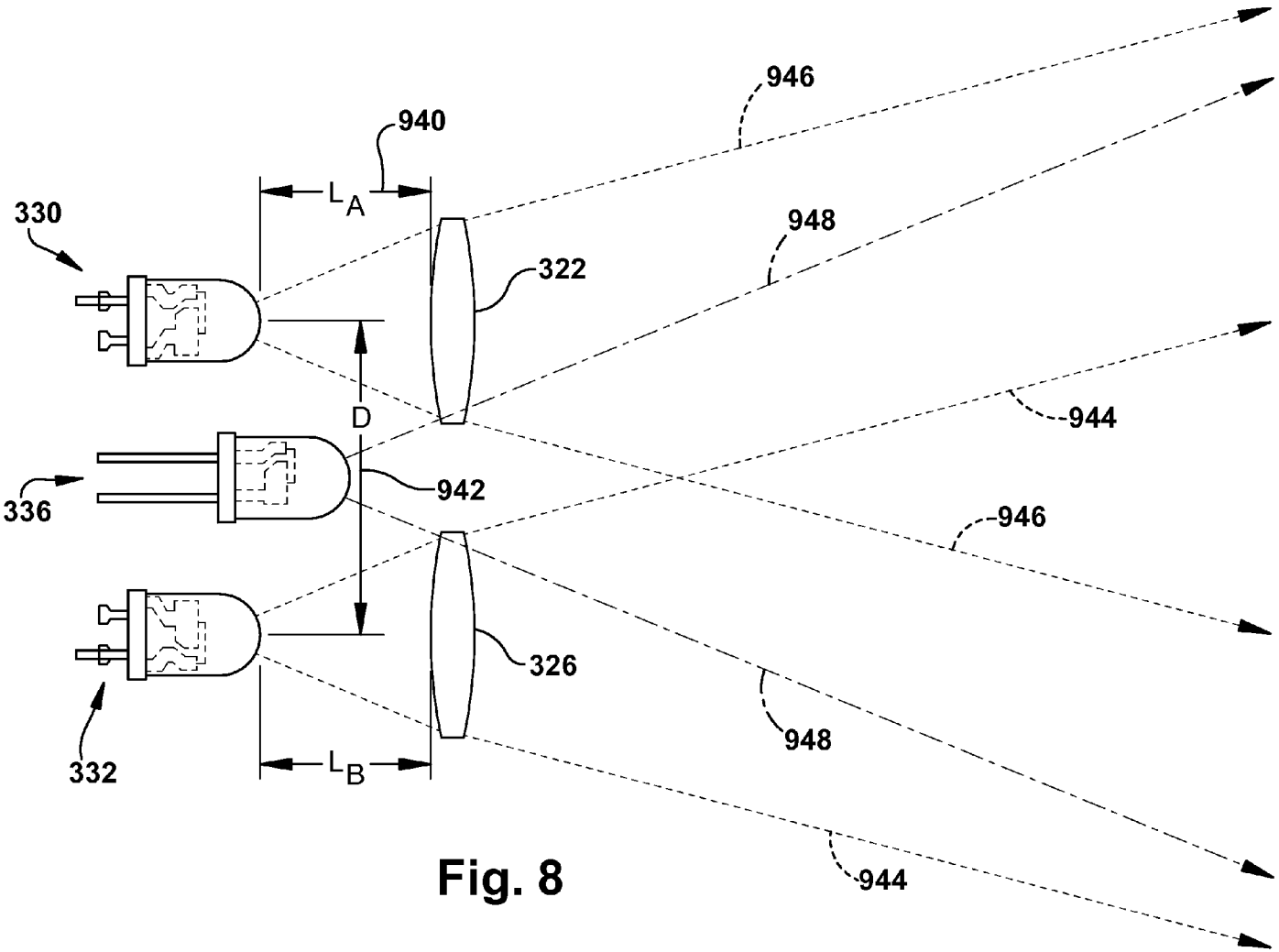
FIG. 8 is a diagram illustrating an example of a suitable lens arrangement.

FIG. 8 is a diagram illustrating an example of a suitable lens arrangement. The arrangement includes a first LED 330, a second LED 332, a third LED 336, a first magnifier lens 322, and a second magnifier lens 326.

The first and second LEDs 330 and 332 are arranged relative to magnifier lenses 322 and 326 to produce first and second light beams 946 and 944, respectively. The first LED 24 illuminates the first magnifier lens 322 to generate a first light beam 946 generally within a defined full angle field of view of about forty degrees (40°). Substantially all of the light generated by the first LED 330 is illuminated onto the first magnifier lens 322 which magnifies and redirects the first light beam in a path shown. The second LED 332 likewise illuminates the second magnifier lens 326 to generate a second light beam 944 within a defined full angle field of view of about forty degrees (40°). The light beam generated by the second LED 332 is illuminated onto the second magnifier lens 326 which refocuses and directs the light beam in a second path shown by dashed lines 944.

Figure 9:
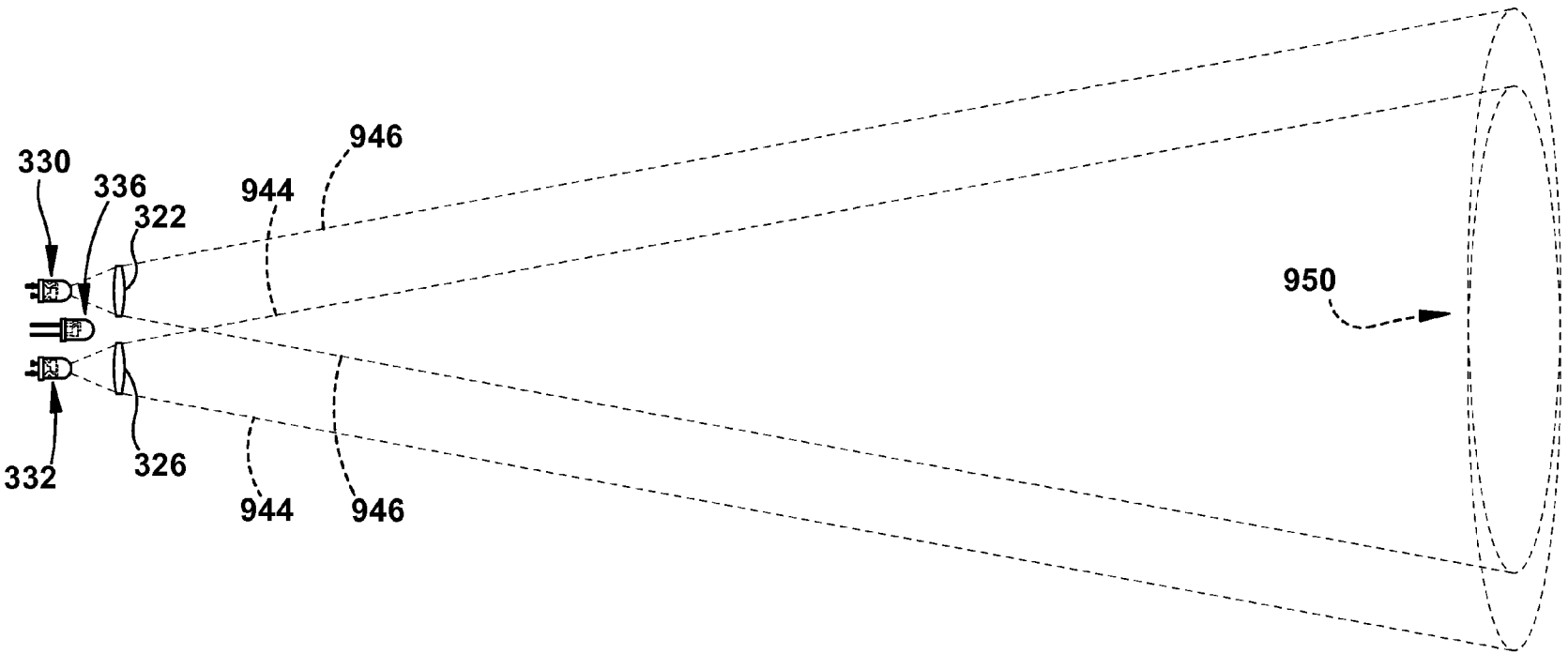
FIG. 9 is a diagram illustrating a light beam generated by a lighting device.

The lenses 322 and 326 are selectively aligned with the first and second LEDs 330, 332. In one example, the lenses 322, 326 are tilted slightly toward each other. FIGS. 8 and 9 show this example for illustrative purposes.

As shown in FIG. 9, the light beams 944 and 946 are shown substantially overlapping and substantially cover a common target area 950 to form a single spotlight having symmetry and uniform intensity. By employing the arrangement of the first and second LEDs 330, 332 and lenses 322, 326, respectively, focused onto a single target area 950, increased brightness illumination is achieved in target area 950.

Returning to FIG. 8, the third LED 336 is shown generating a light beam in a path shown by phantom lines 948 that extends substantially between an opening between magnifier lenses 322 and 326. The light beam 948 generated by LED 336 is emitted within a full angle wide field of view of about forty degrees (40°). Accordingly, a substantial portion of the light beam 948 generated is not directed through a magnifier lens and, hence, is not magnified and focused onto the focal target area 950. Instead, the third LED 336 illuminates a wider angle of coverage and, thus, operates more as a floodlight.

The first and second LEDs 330 and 332 are spaced apart from each other by distance D which is measured from the center of the LEDs. In one embodiment, distance D is about 18.2 mm. The magnifier lenses 322 and 326 can be glass (SF5) double convex magnifier lenses which, in one embodiment, are 9 mm in diameter with a 9 mm effective focal length. Magnifier lens 326 is positioned orthogonal to the second LED 332 while magnifier lens 322 is positioned orthogonal to the first LED 330. The central focal axes of first and second LEDs are parallel to each other. The surface of the magnifier lenses 322 and 326 can be placed from the tip of their respective LEDs at a distance $L_A$ and $L_B$ to allow for a back focal length of 7.9 mm, according to one embodiment. This is the distance $L_A$ and $L_B$ between the focal point within the first and second LEDs 330, 332 and the surface of the corresponding lenses 322, 326.

As stated above, the lenses 322, 326 are aligned with the LEDs 330, 332. FIG. 9 illustrates a tilt of the lenses 322 and 326 towards each other to yield the substantially overlapping spot 950 at a selected distance. The inventors of the present invention appreciate that the selected distance varies for use. For a clip light device attaché to a brim of a cap, the inventors of the present invention appreciate that a selected distance of 3-5 feet or a selected distance of 1-2 meters yields suitable results. For example, the clip light attached to a brim of a cap could be used for working on a car, working on a tractor, hiking, jogging, and the like. A shorter value might work for reading, but could be too short for other uses. The creation of the substantially overlapping spot 950 can be referred to as an overlapping spot mode. To obtain the overlapping spot 950 at the selected distance, the lenses 322, 326 are tilted toward each other at a selected angle. The focusing properties of the lenses 322, 326 are also considered as a factor to yield a selected spot 950.

Figure 10:
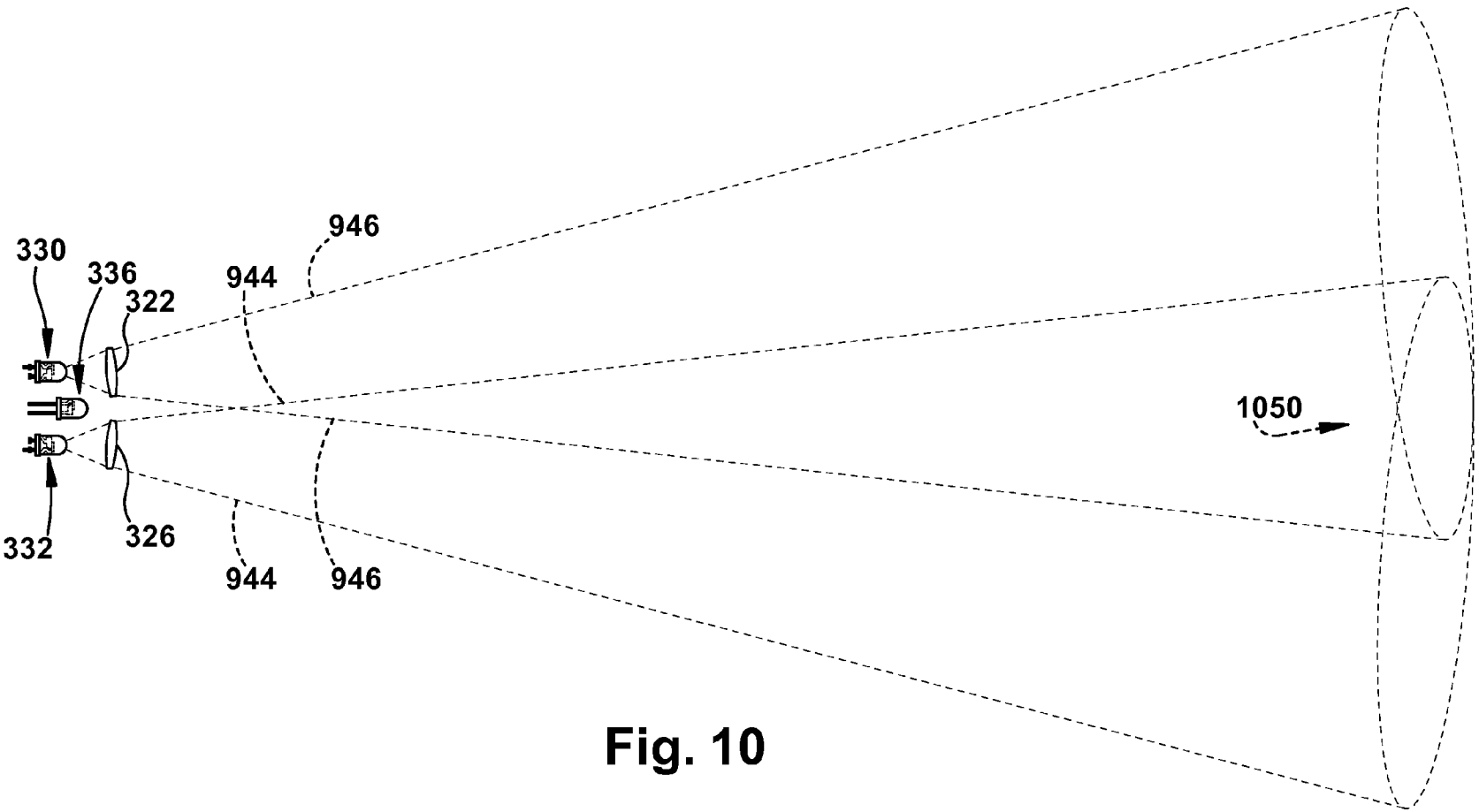
FIG. 10 is a diagram illustrating a light beam generated by a lighting device.

FIG. 10 illustrates the lenses 322, 326 being slightly divergent to yield a partially overlapping spot 1050 at a selected distance. In this example, a single spot beam of higher intensity is not desired. Instead, the overlapping spot 1050 covers a wider area. The beams 946 and 944 travel substantially parallel to each other. To obtain the partially overlapping spot 1050 at the selected distance, the lenses 322, 326 are tilted toward away from each other at a selected angle. The focusing properties of the lenses 322, 326 are also considered as a factor to yield the partially overlapping spot 1050.

Figure 11:
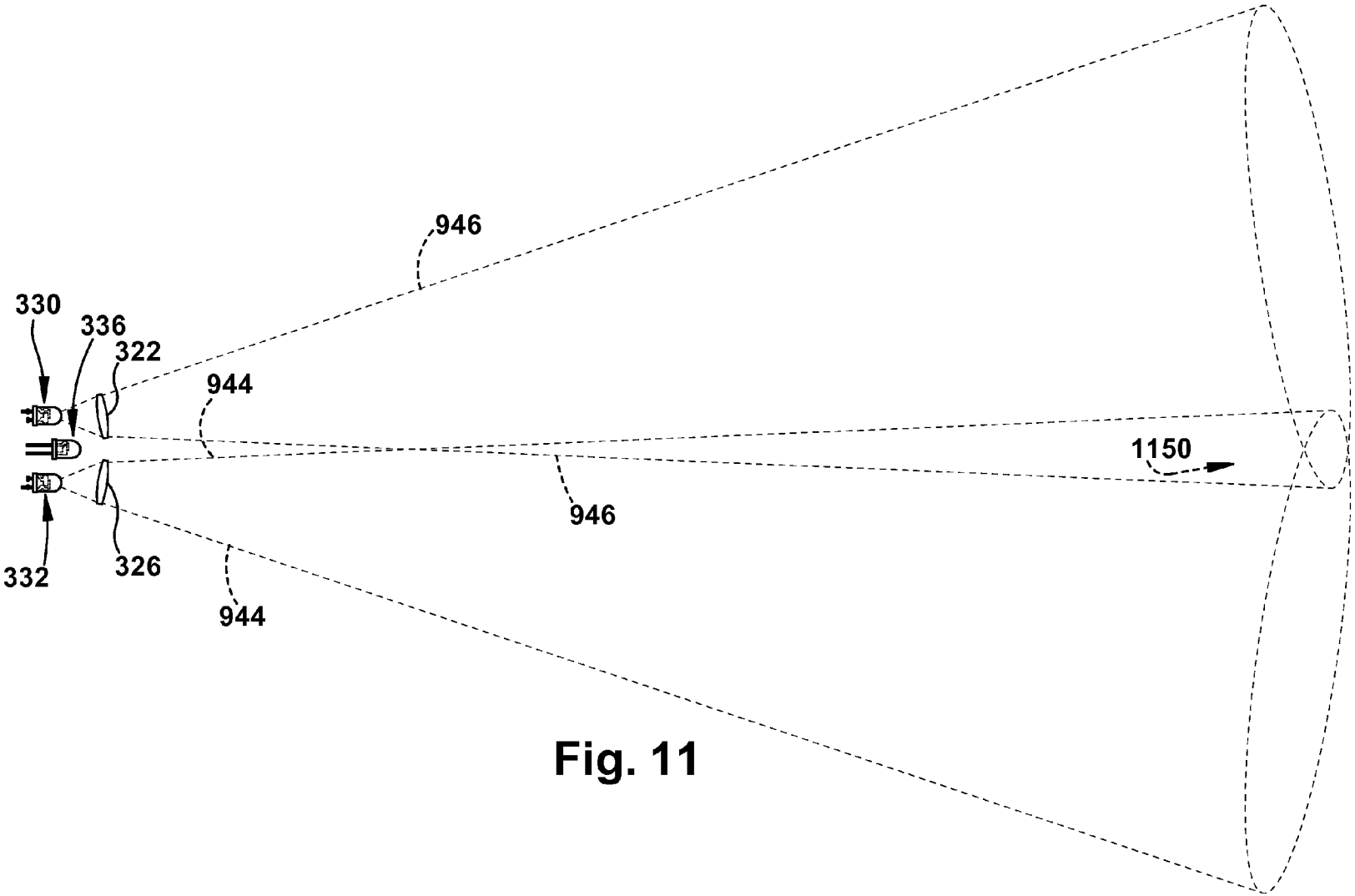
FIG. 11 is a diagram illustrating a light beam generated by a lighting device.

FIG. 11 illustrates the lenses 322, 326 tilted slightly away or divergent from each other. The lenses 322, 326 cause the beams 946, 944, respectively, to diverge away from each other. The beams 946, 944 converge in only a relatively small area. As a result, the beams 946, 944 diverge and form a spot 1150 covering an even wider area than that of the spot 1050 of FIG. 10. In other examples, the beams 946, 944 diverge such that they form separate non-overlapping spots. The divergence of the beams can also be referred to as a divergent mode.

To obtain the partially overlapping spot 1150 at the selected distance, the lenses 322, 326 are tilted toward away from each other at a selected angle. Here, the selected angle is greater than that of FIG. 10. The focusing properties of the lenses 322, 326 are also considered as a factor to yield the partially overlapping spot 1050. A selected angle of an even greater value can be selected to yield a non-overlapping spot.

In an alternate embodiment, the lenses 322, 326 are axially parallel to yield a partially overlapping spot at a selected distance. The beams 946 and 944 travel substantially parallel to each other.

It is appreciated that a lighting device of the invention can incorporate spot modes, flood modes, and divergent modes in a single device. In one example, one or more lenses are provided for each mode and corresponding light sources are selectively activated to yield those modes.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

We claim:

1. A clip-on lighting device, comprising:

a housing comprising a front end, a lower surface and an upper surface;

a plurality of light sources positioned at the front end of the housing;

a cover at the front end of the housing in front of the plurality of light sources, wherein the cover is at least partially transparent;

a plurality of lenses integrated into the cover and proximate to the plurality of light sources, wherein at least some of the plurality of light sources emit substantial light through the plurality of lenses and another of the plurality of light sources emits substantial light through the at least partially transparent cover in a region between adjacent lenses; and a clip coupled to the lower surface.

2. The device of claim 1, wherein the plurality of lenses are magnifier lenses and correspond to the light sources and there are less lenses than light sources and at least one of the light sources emits light that does not traverse any of the lenses.

3. The device of claim 1, further comprising an apparel item, wherein the clip is removably attached to the apparel item.

4. The device of claim 3, wherein the apparel item is a baseball cap with a brim, wherein the clip is removably attached to the brim.

5. The device of claim 1, wherein the plurality of light sources are operable in a flood mode and a spot mode.

6. The device of claim 1, further comprising a switch that selects a mode of operation.

7. The device of claim 1, wherein the plurality of light sources include a first LED, a second LED, and a third LED.

8. The device of claim 7, wherein the plurality of lenses include a first lens axially aligned with the first LED and a second lens axially aligned with the second LED, wherein the third LED emits substantially all light through the cover in a region between the first and second lenses.

9. The device of claim 7, wherein the first LED is aligned with a first lens of the plurality of lenses and the second LED is aligned with a second lens of the plurality of lenses.

10. The device of claim 9, wherein the first lens and the second lens are aligned to yield parallel light beams.

11. The device of claim 9, wherein the first lens and the second lens are tilted towards each other at a selected angle to yield a substantially overlapped spot at a selected distance.

12. The device of claim 9, wherein the first lens and the second lens are tilted away from each other at a selected angle to yield a divergent spot at a selected distance.

13. The device of claim 1, wherein the plurality of light sources are operable in a divergent mode.

14. The device of claim 1, further comprising a battery to supply power that supplies power for the plurality of light sources.

15. The device of claim 14, wherein the battery is a coin cell lithium battery.

16. The device of claim 14, wherein the battery includes a lithium iron disulfide roundcell.

17. A method of operating a clip light, the method comprising:

providing a clip light having a plurality of light sources and a plurality of lenses integrated into a cover in front of the plurality of light sources, wherein at least some of the plurality of light sources emit substantial light through the plurality of lenses and another of the plurality of light sources emits substantial light through the at least partially transparent cover in a region between adjacent lenses;

attaching the clip light to an apparel item; and activating the clip light to emit light from the plurality of light sources.

18. The method of claim 17, further comprising selecting a spot mode and emitting the light through the plurality of lenses.

19. The method of claim 17, further comprising selecting a divergent mode.

20. The method claim 17, further comprising selecting an area mode wherein the light from at least one of the plurality of light sources does not substantially pass through the plurality of lenses.

* * * * *